United States Patent [19]

Crandall

[11] 4,407,317

[45] Oct. 4, 1983

[54] UMBRELLA REVERSAL PREVENTION STRUCTURE

[76] Inventor: Melvin Crandall, 4207 W. Howard St., Skokie, Ill. 60076

[21] Appl. No.: 244,158

[22] Filed: Mar. 16, 1981

[51] Int. Cl.[3] ..... A45B 25/22

[52] U.S. Cl. ..... 135/27

[58] Field of Search ..... 135/27, 1 R; 24/32, 24/34, 35, 68 E, 68 F, 68 PP, 68 BT, 116 A; 128/501

[56] References Cited

U.S. PATENT DOCUMENTS

| | | | |
|---|---|---|---|
| 548,425 | 10/1895 | Biddle | 135/1 R |
| 785,582 | 3/1905 | Stempel | 135/1 R |
| 2,005,334 | 6/1935 | Casper | 24/116 A |
| 2,007,431 | 7/1935 | Malcom | 24/116 A |
| 3,032,047 | 5/1962 | Wendorf | 135/27 X |
| 3,091,827 | 6/1963 | Randrup | 24/68 F |
| 3,311,113 | 3/1967 | Sayers | 128/501 X |

OTHER PUBLICATIONS

Dritz Never-Slip Belt and Buckle Kit, p. 352, Sears Fall and Winter 1963 Catalog.

*Primary Examiner*—Harland S. Skogquist
*Attorney, Agent, or Firm*—Wood, Dalton, Phillips, Mason & Rowe

[57] ABSTRACT

An umbrella reversal prevention structure including a plurality of flexible guys having outer ends connected one each to different ones of the resilient ribs of the umbrella. The inner ends of the guys are connected to the shaft of the umbrella adjacent its outer end. The guys are provided with adjusting structure for adjusting the length thereof to provide a preselected tension in each guy for effectively preventing undesirable displacement of the resilient rib outer ends outwardly from the normal disposition thereof in the open bowed configuration of the umbrella, thereby to prevent reversal of the umbrella structure as from a high wind force directed outwardly thereagainst.

10 Claims, 4 Drawing Figures

UMBRELLA REVERSAL PREVENTION STRUCTURE

BACKGROUND OF THE INVENTION

1. Field of the Invention

This invention relates to umbrellas and in particular to means for preventing undesirable blowout or reversal of the open umbrella configuration as from high winds or the like.

2. Description of the Background Art

The problem of blowout or undesirable reversal of the concave configuration of an umbrella due to high winds or the like acting outwardly thereagainst has long been a vexatious problem. Thus, as shown in Hadfield U.S. Pat. No. 559,577, one solution to this problem attempted in the prior art was to provide a spring acting between cords connected at one end to a sleeve on the umbrella shaft, and at the other end to the outer ends of the umbrella ribs, and to the rigid ribs extending from the shaft to the midportion of the resilient ribs for holding the umbrella in the open position. The springs are arranged to be selectively operable to urge the boat configuration to one of greater tension so as to strengthen the ribs in windy or stormy weather. In normal weather, the tension springs are relieved so as to pay out the control cords along the ribs to return to the normal position. The tension springs provide a supplemental resilient force for urging the umbrella to a more deeply concave configuration when desired.

In U.S. Pat. No. 773,499 of D. Hirsch et al, an umbrella is disclosed wherein a coil spring is provided on the umbrella shaft for similarly urging the tension cords resiliently so as to resist turning of the umbrella inside out.

Hans Wagner shows, in U.S. Pat. No. 1,093,160, an umbrella structure having bands employed as stiffeners acting between the center stick of the umbrella, which is offset from the main support post thereof, and the center portion of the ribs.

Herman J. Raabe shows, in U.S. Pat. No. 1,167,431, an umbrella construction having reinforcing rods connected between the resilient ribs and rigid ribs of the umbrella.

In U.S. Pat. No. 2,522,645, Salvatore M. Senna shows an umbrella having means for reinforcing the ribs comprising a flexible member made of wire, nylon strand, or braid, or other flexible material resistant to stretching. The connector extends from a first connection adjacent the distal end of the resilient ribs through an eye carried on the post of the umbrella and to a second connector adjacent the inner end of the resilient ribs. Each of the ends of the flexible connector is fixedly connected to its associated eye by tying or by a clip secured to the ends of the connector.

Ovaldo Wendorf discloses, in U.S. Pat. No. 3,032,047, a storm umbrella having a plurality of beaded chain or cords made of fiberglass, nylon, or the like, fixedly connected between the distal ends of the resilient bowed ribs and a connector on the umbrella shaft.

SUMMARY OF THE INVENTION

The present invention comprehends an improved umbrella reversal prevention structure including a plurality of flexible guys each having an inner end and an outer end, the outer ends of the guys being connected one each to different ones of the resilient rib outer ends, means for connecting the inner ends of the guys to the shaft at the shaft outer end, and adjusting means associated with each of the guys for fixedly adjusting the length thereof to provide a preselected tension on each guy for effectively preventing undesirable displacement of the resilient rib outer ends outwardly from the normal disposition thereof in the bowed configuration, thereby to prevent reversal of the inwardly concave configuration in use of the umbrella as from a high wind force directed outwardly against the cover.

The guys are formed of substantially inextensible strap material in the illustrated embodiment.

In the illustrated embodiment, a loop is provided in the outer end of each guy adapted to encircle the outer end of the associated resilient rib for connection thereto.

The means for forming the loop in the outer end of the guy may comprise an annular element frictionally retained in encircling relationship to the looped end portion of the guy.

The inner ends of the guys are connected, in the illustrated embodiment, to the umbrella shaft by means forming a loop in the inner end of each guy and a connecting element threaded through the loops and retained in encircling relationship to the shaft outer end.

In the illustrated embodiment, the connecting element comprises an adjustable strap.

The inner ends of the guys may be fixed in the loop configuration by annular members crimped about the looped end.

In the illustrated embodiment, the adjusting means comprises a buckle including a loop member defining a center opening and a crosspiece extending across the opening to divide the center opening into a pair of strap-passing openings, the outer end of the strap being secured to the crosspiece and including portions extending sequentially through the strap-passing openings.

The outer end of each strap includes a first portion passed in a first direction through a first of the strap-passing openings, thence in an opposite direction through the second of the strap-passing openings, and thence to the distal portion thereof connected to the outer end of the resilient rib, and a second portion extending back from the distal portion, in the direction through the second of the strap-passing openings, in the second direction through the first of the strap-passing openings, and thence to the connection to the crosspiece.

In the illustrated embodiment, the distal portion of the strap is retained in a loop by an adjustably positioned ring encircling the first and second portions adjacent the distal portion.

The umbrella reversal prevention structure of the present invention is extremely simple and economical of construction, while yet providing a positive blowout prevention means therein.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 1:
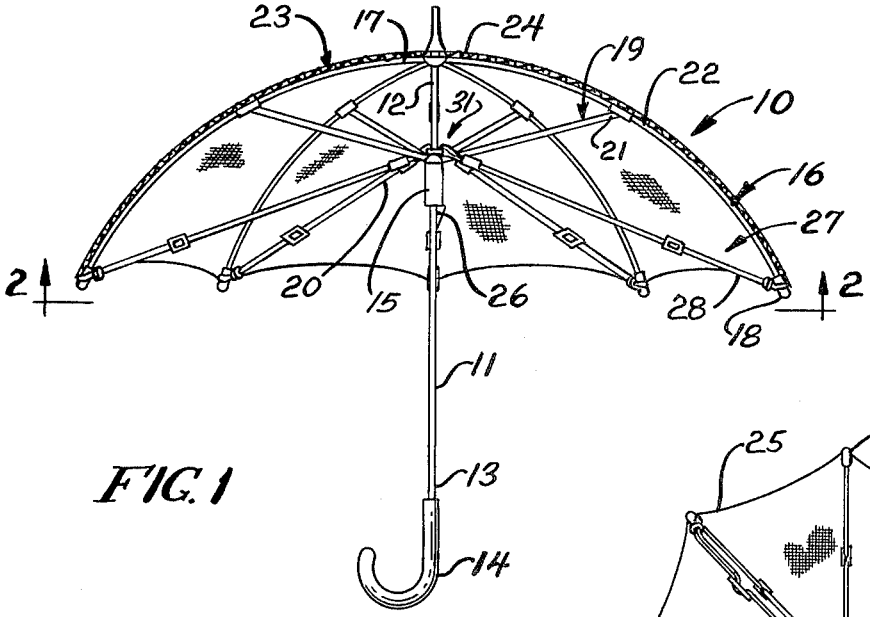
FIG. 1 is a fragmentary diametric view of an umbrella provided with reversal prevention means embodying the invention.

In the illustrative embodiment of the invention as disclosed in the drawing, an umbrella generally designated 10 is shown to include a shaft 11 having an outer end 12 and an inner end 13 provided with a handle 14.

An annular runner 15 is coaxially longitudinally movably mounted on the shaft. A plurality of resilient ribs 16 define inner ends 17 connected to the outer end 12 of the shaft. The resilient ribs further define outer ends 18, which, in the open arrangement of the umbrella as seen in FIG. 2, are spaced equiangularly about the axis of shaft 11.

The umbrella further includes a plurality of rigid ribs 19, each having an inner end 20 connected to the runner 15, and an outer end 21 connected to a midportion 22 of the resilient ribs 16.

Figure 2:
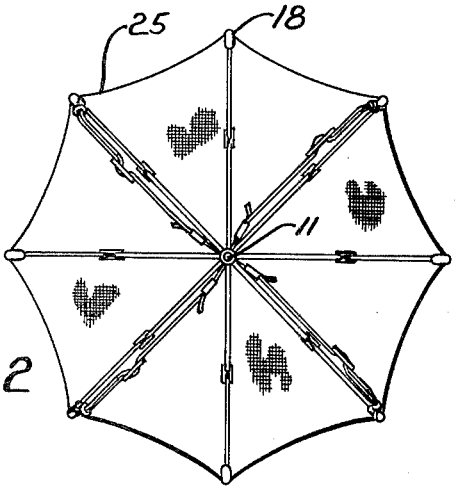
FIG. 2 is a horizontal section taken substantially along the line 2—2 of FIG. 1.

The umbrella further includes a flexible sheet cover 23 having a midportion 24 secured to the shaft outer end 12, and a peripheral portion 25 secured to the resilient rib outer ends 18, as illustrated in FIGS. 1 and 2.

The umbrella structure further includes a conventional spring-loaded latch 26 for releasably retaining the runner 15 in a disposition wherein the rigid ribs 19 urge the resilient ribs 16 to an inwardly bowed configuration, with the cover defining an inwardly concave configuration, as best seen in FIG. 1. Upon release of the latch 26, the umbrella may be folded to a closed configuration wherein the ribs and cover closely embrace the shaft between end portions 12 and 13 in the well known manner.

As indicated briefly above, the invention comprehends the provision for use with such an umbrella structure of an improved reversal prevention means generally designated 27. In the illustrated embodiment, the reversal prevention means is defined by a plurality of flexible guys 28. The guys illustratively may be formed of a suitable substantially inextensible strap material, such as nylon strap. Each of the guys has an inner end 29 and an outer end 30. The outer ends of the guys are connected one each to different ones of the resilient rib outer ends 18. In the illustrated embodiment, as best seen in FIG. 2, four such guys are provided, it being understood that any suitable number of guys may be employed within the scope of the invention, as desired. As will be obvious to those skilled in the art, however, it is preferable that the guys be arranged symmetrically about the shaft axis to provide optimum reversal prevention.

Figure 3:
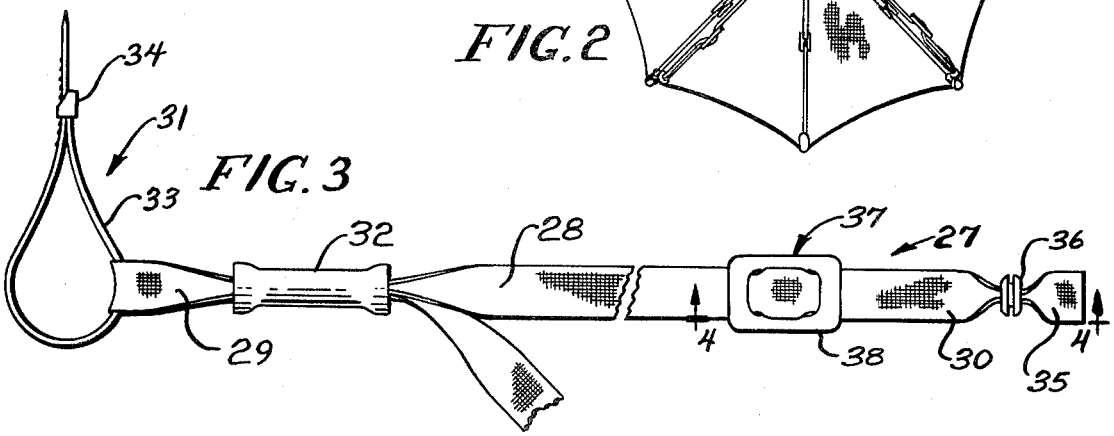
FIG. 3 is a plan view of the reversal prevention means of the invention with a portion of the strap broken to facilitate illustration thereof.

The invention further comprehends the provision of means generally designated 31 for connecting the inner ends 29 of the guys to the shaft at the shaft outer end 12. In the illustrated embodiment, the inner ends 29 of the respective guys are, as shown in FIG. 3, secured to define a loop by a crimped connector 32. A connecting element 33 is threaded through the loops of the respective guys and retained in encircling relationship to the shaft outer end 12 by suitable locking means 34. In the illustrated embodiment, the connecting element comprises a flexible strap formed of a suitable synthetic resin and the locking means comprises a conventional strap lock, well known to those in the art.

The outer end 30 of each of the guys defines a distal looped portion 35 secured in adjusted disposition by a friction ring 36. Friction ring 36 may be formed of a suitable material, such as rubber or synthetic resin, and has an inner diameter sufficient to pass the looped distal end 35 outwardly therethrough but effectively retains the looped end in the looped configuration after being passed therethrough.

The invention further comprehends the provision of adjusting means associated with each of the guys for fixedly adjusting the length thereof to provide a preselected tension in each guy for effecting optimum prevention of undesirable displacement of the resilient rib outer ends outwardly from the normal bowed configuration of the umbrella illustrated in FIG. 1. In the illustrated embodiment, the adjusting means comprises a buckle 37, including a loop member 38 defining a center opening 39 which is divided by a crosspiece 40 extending across the opening into a pair of first and second strap-passing openings 41 and 42, respectively.

The distal end 43 of the guy is secured in a loop about crosspiece 40 by a locking ring 44. The outer end of the guy strap includes a first portion 45 extending in a first direction transversely through the first strap-passing opening 41, over the crosspiece 40 and thence in an opposite transverse direction through the second strap-passing opening 42. The strap end portion 45 continues through the locking ring 36 to the distal looped portion 35 of the guy.

The end of the guy is further defined by a second strap end portion 46 which extends back from the looped end 35 through the locking ring 36, in the second transfer direction through second strap-passing opening portion 42 over the crosspiece 40 and in the reverse direction, through the first strap-passing opening portion 41 to the inner end 29 of the strap. This arrangement is best seen with reference to FIG. 4, which illustrates the arrangement of the strap adjusting means as during an adjustment of the length of the outer end portion 30 in providing the desired tension in the guy strap when installed in the umbrella, as seen in FIG. 1.

The use of the reversal prevention means 27 of the present invention is extremely simple. The structure is adapted for installation on existing umbrellas by the simple expedient of firstly securing the inner ends 29 of the respective guy straps to the shaft portion 12 by the connecting element 31 threaded through the looped ends 29 of the respective guys and mounted to the shaft end 12 in encircling relationship thereto, as seen in FIG. 1.

The distal ends of the guy straps may then be connected to the outer ends 18 of the corresponding resilient ribs 16 by looping the end portions 35 about the projecting ends 18 of the resilient ribs, as illustrated in FIG. 2.

Figure 4:
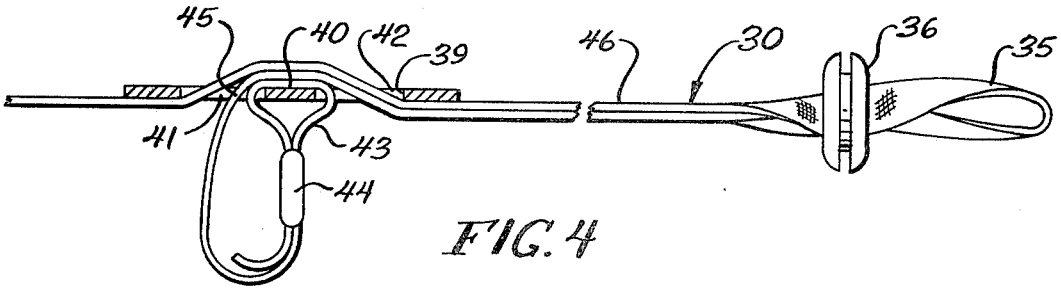
FIG. 4 is a fragmentary enlarged section taken substantially along the line 4—4 of FIG. 3.

The umbrella is then arranged in the open condition of FIG. 1 and the tension in each of the guy straps is adjusted by suitably adjusting the length of the end portions 30 by manipulation of the strap portions 45 and 46 relative to the buckle 37 and the loop securing ring 36. As seen in FIG. 4, sufficient excess length of strap portion 45 is provided adjacent the looped end 43 so as to permit adjustment in both a lengthening and shortening direction as desired in providing the desired tension in the guy straps.

As seen in FIG. 1, the tension in the guy straps urges the locking element 31 downwardly to the runner 15 in the open configuration of the umbrella. When the umbrella is brought to the closed configuration by release of latch 26, as discussed above, the tension in the guy straps is relieved so as to permit the umbrella to be folded to the closed configuration in the normal manner with the guy straps being retained within the closed umbrella.

Adjustment of the guy straps may be made at any time commensurate with the weather conditions, relaxation of the umbrella components, etc.

The reversal prevention structure 27 is extremely simple while yet providing a substantial improvement in the positive prevention of the umbrella reversal or blowout, thus, substantially extending the useful life of the umbrella at effectively minimum cost and without adversely affecting the normal operation of the umbrella in the normal manner.

As will be obvious to those skilled in the art, where the reversal prevention means is provided in the umbrella by the manufacturer, the means connecting the inner ends of the guys to the shaft may be secured directly to the runner 15, as desired. Further, the connections of the outer ends of the guys to the outer ends of the resilient ribs may be effected by other suitable adjustable connections within the scope of the invention. Similarly, while the invention is disclosed with reference to a best mode of the adjusting means, as will be obvious to those skilled in the art, other suitable strap adjusting structures may be utilized within the broad scope of the invention.

The foregoing disclosure of specific embodiments is illustrative of the broad inventive concepts comprehended by the invention.

I claim:

1. For use with an umbrella having a shaft defining an outer end and an inner end, an annular runner coaxially longitudinally movable on the shaft, a plurality of resilient ribs having inner ends connected to said outer end of the shaft and outer ends, a plurality of rigid ribs having inner ends connected to said runner and outer ends connected one each to midportions of said resilient ribs, a flexible sheet cover having a midportion secured to said shaft outer end and a peripheral portion secured to said resilient ribs outer ends, and means for releasably retaining said runner in a disposition wherein the rigid ribs urge the resilient ribs to an inwardly bowed configuration with the cover defining an inwardly concave configuration, the improvement comprising:

a plurality of flexible guys each having an inner end and an outer end, the outer ends of said guys being connected one each to different ones of said resilient ribs outer ends;

means for connecting the inner ends of said guys to said shaft at said shaft outer end; and adjusting means associated with each of said guys for fixedly adjusting the length thereof to provide a preselected tension in each guy for effectively preventing undesirable displacement of the resilient rib outer ends outwardly from the normal disposition thereof in said bowed configuration thereby to prevent reversal of the inwardly concave configuration in use of the umbrella as from a high wind forced directed outwardly against said cover, said adjusting means comprising means including a first portion comprising means for repetitively adjusting the length of the guys to accommodate changes in the umbrella parameters due to weather conditions, relaxation of the umbrella components, and the like, and a second portion providing a permanent strap length fixation permitting adjustment of the guys by said first portion in both lengthening and shortening directions as desired, said guys comprising straps, said first portion of the adjusting means comprising a buckle including a loop member defining a center opening and a crosspiece extending across said opening to divide said center opening into a pair of strap-passing openings, said outer end of the strap being secured to said crosspiece and including portions extending sequentially through said strap-passing openings, said outer end of each strap including a first portion passed in a first direction through a first of said strap-passing openings, thence in an opposite direction through the second of said strap-passing openings, and thence in said distal portion thereof connected to said outer end of the resilient rib, and a second portion extending back from said distal portion, in said first direction through said second of said strap-passing openings, in said second direction through said first of said strap-passing openings, and thence to the connection to said crosspiece, said distal portion of the strap being retained in an adjustable loop by a releasable holding element encircling said first and second portions adjacent said distal portion.

2. The improved umbrella reversal prevention structure of claim 1 wherein said guys are formed of substantially inextensible strap material.

3. The improved umbrella reversal prevention structure of claim 1 wherein said guys are formed of substantially inextensible nylon strap material.

4. The improved umbrella reversal prevention structure of claim 1 including means for forming a loop in the outer end of each guy adapted to encircle the outer end of the associated resilient rib for connecting said opposite end to said resilient rib outer end.

5. The improved umbrella reversal prevention structure of claim 1 including means for forming a loop in the outer end of each guy adapted to encircle the outer end of the associated resilient rib for connecting said opposite end to said resilient rib outer end, said loop forming means comprising an annular element frictionally retained in encircling relationship to a layered end portion of the guy.

6. The improved umbrella reversal prevention structure of claim 1 wherein said second portion of the adjusting means comprises means for connecting the inner ends of the guys to the shaft defined by a loop in the inner end of each guy, and a connecting element threaded through said loops and retained in encircling relationship to said shaft outer end.

7. The improved umbrella reversal prevention structure of claim 1 wherein said second portion of the adjusting means comprises means for connecting the inner ends of the guys to the shaft defined by a loop in the inner end of each guy, and an adjustable strap threaded through said loops and retained in encircling relationship to said shaft outer end.

8. The improved umbrella reversal prevention structure of claim 1 wherein said second portion of the adjusting means comprises an annular member fixedly crimped about a looped end portion of the guy.

9. For use with an umbrella having a shaft defining an outer end and an inner end, an annular runner coaxially longitudinally movable on the shaft, a plurality of resilient ribs having inner ends connected to said outer end of the shaft and outer ends, a plurality of rigid ribs having inner ends connected to said runner and outer ends connected one each to midportions of said resilient ribs, a flexible sheet cover having a midportion secured to said shaft outer end and a peripheral portion secured to said resilient ribs outer ends, and means for releasably retaining said runner in a disposition wherein the rigid ribs urge the resilient ribs to an inwardly bowed configuration with the cover defining an inwardly concave configuration, the improvement comprising:

a plurality of flexible guys each having an inner end and an outer end, the outer ends of said guys being connected one each to different ones of said resilient ribs outer ends;

means for connecting the inner ends of said guys to said shaft at said shaft outer end; and adjusting means associated with each of said guys for fixedly adjusting the length thereof to provide a preselected tension in each guy for effectively preventing undesirable displacement of the resilient rib outer ends outwardly from the normal disposition thereof in said bowed configuration thereby to prevent reversal of the inwardly concave configuration in use of the umbrella as from a high wind force directed outwardly against said cover, said adjusting means comprising means including a first portion comprising means for repetitively adjusting the length of the guys to accommodate changes in the umbrella parameters due to weather conditions, relaxation of the umbrella components, and the like, and a second portion providing a permanent strap length fixation permitting adjustment of the guys by said first portion in both lengthening and shortening directions as desired, said guys comprising straps, said first portion of the adjusting means comprising a buckle including a loop member defining a center opening and a crosspiece extending across said opening to divide said center opening into a pair of strap-passing openings, said outer end of the strap being secured to said crosspiece and including portions extending sequentially through said strap-passing openings, said outer end of each strap including a first portion passed in a first direction through a first of said strap-passing openings, thence in an opposite direction through the second of said strap-passing openings, and thence in said distal portion thereof connected to said outer end of the resilient rib, and a second portion extending back from said distal portion, in said first direction through said second of said strap-passing openings, in said second direction through said first of said strap-passing openings, and thence to the connection to said crosspiece, said distal portion of the strap being retained in a loop by an adjustably positioned ring encircling said first and second portions adjacent said distal portion.

10. For use with an umbrella having a shaft defining an outer end and an inner end, an annular runner coaxially longitudinally movable on the shaft, a plurality of resilient ribs having inner ends connected to said outer end of the shaft and outer ends, a plurality of rigid ribs having inner ends connected to said runner and outer ends connected one each to midportions of said resilient ribs, a flexible sheet cover having a midportion secured to said shaft outer end and a peripheral portion secured to said resilient ribs outer ends, and means for releasably retaining said runner in a disposition wherein the rigid ribs urge the resilient ribs to an inwardly bowed configuration with the cover defining an inwardly concave configuration, the improvement comprising:

a plurality of flexible guys each having an inner end and an outer end, the outer ends of said guys being connected one each to different ones of said resilient ribs outer ends;

means for connecting the inner ends of said guys to said shaft at said shaft outer end; and adjusting means associated with each of said guys for fixedly adjusting the length thereof to provide a preselected tension in each guy for effectively preventing undesirable displacement of the resilient rib outer ends outwardly from the normal disposition thereof in said bowed configuration thereby to prevent reversal of the inwardly concave configuration in use of the umbrella as from a high wind force directed outwardly against said cover, said adjusting means comprising means including a first portion comprising means for repetitively adjusting the length of the guys to accommodate changes in the umbrella parameters due to weather conditions, relaxation of the umbrella components, and the like, and a second portion providing a permanent strap length fixation permitting adjustment of the guys by said first portion in both lengthening and shortening directions as desired, said guys comprising straps, said first portion of the adjusting means comprising a buckle including a loop member defining a center opening and a crosspiece extending across said opening to divide said center opening into a pair of strap-passing openings, said outer end of the strap being secured to said crosspiece and including portions extending sequentially through said strap-passing openings, said outer end of each strap including a first portion passed in a first direction through a first of said strap-passing openings, thence in an opposite direction through the second of said strap-passing openings, and thence in said distal portion thereof connected to said outer end of the resilient rib, and a second portion extending back from said distal portion, in said first direction through said second of said strap-passing openings, in said second direction through said first of said strap-passing openings, and thence to the connection to said crosspiece, said distal portion of the strap being retained in a loop by an adjustably positioned friction-gripping element encircling said first and second portions adjacent said distal portion.

* * * * *